US007721416B2

(12) United States Patent
Rodriguez-Amaya et al.

(10) Patent No.: US 7,721,416 B2
(45) Date of Patent: May 25, 2010

(54) METHOD FOR INSTALLING A MAGNET VALVE

(75) Inventors: Nestor Rodriguez-Amaya, Stuttgart (DE); Harald Volk, Waiblingen (DE); Andreas Sterr, Nuertingen (DE); Markus Bayer, Vaihingen/Enz (DE)

(73) Assignee: Robert Bosch GmbH, Stuttgart (DE)

( * ) Notice: Subject to any disclaimer, the term of this patent is extended or adjusted under 35 U.S.C. 154(b) by 622 days.

(21) Appl. No.: 10/593,959

(22) PCT Filed: Jan. 19, 2005

(86) PCT No.: PCT/EP2005/050210

§ 371 (c)(1),
(2), (4) Date: Sep. 22, 2006

(87) PCT Pub. No.: WO2005/095786

PCT Pub. Date: Oct. 13, 2005

(65) Prior Publication Data

US 2008/0251612 A1 Oct. 16, 2008

(30) Foreign Application Priority Data

Mar. 30, 2004 (DE) ..... 10 2004 015 362

(51) Int. Cl.
*H01F 7/08* (2006.01)

(52) U.S. Cl. ..... 29/607; 29/602.1; 29/890.124; 29/759; 29/760; 239/585.3; 251/129.16

(58) Field of Classification Search ..... 29/607, 29/602.1, 606, 890.124, 890.125, 757, 759, 29/760; 239/585.1, 585.3; 251/129.16
See application file for complete search history.

(56) References Cited

U.S. PATENT DOCUMENTS

| | | | | |
|---|---|---|---|---|
| 5,373,992 | A | 12/1994 | Reiter | |
| 5,752,308 | A * | 5/1998 | Maley et al. | 29/602.1 |
| 5,961,052 | A | 10/1999 | Coldren et al. | |
| 6,027,049 | A * | 2/2000 | Stier | 239/585.1 |
| 6,520,600 | B1 | 2/2003 | Tackett et al. | |
| 6,530,556 | B1 | 3/2003 | Boecking | |
| 2002/0148448 | A1 | 10/2002 | Stier et al. | |

FOREIGN PATENT DOCUMENTS

| | | | | |
|---|---|---|---|---|
| DE | 39 25 212 | A1 | 1/1991 | |
| DE | 198 37 333 | A1 | 2/2000 | |
| DE | 100 05 015 | A1 | 8/2001 | |
| DE | 101 44 342 | A1 | 3/2002 | |
| JP | 06084629 | A * | 3/1994 | 29/602.1 X |
| WO | WO 99/15781 | A1 | 4/1999 | |

* cited by examiner

*Primary Examiner*—A. Dexter Tugbang
(74) *Attorney, Agent, or Firm*—Ronald E. Greigg

(57) ABSTRACT

A magnet valve is installed by a method in which the fully machined valve member is locked in a receptacle of a fixed installation device. A magnet plate and a spacer plate are mounted on a receiving mandrel. The magnet plate, spacer plate and valve member are pressed against the receptacle, then the magnet plate and the spacer plate are displaced relative to the valve member, and the armature is secured to the receiving mandrel of the valve member in such a way that the armature then rests on the magnet plate.

6 Claims, 5 Drawing Sheets

METHOD FOR INSTALLING A MAGNET VALVE

CROSS-REFERENCE TO RELATED APPLICATIONS

This application is a 35 USC 371 application of PCT/EP 2005/050210 filed on Jan. 19, 2005.

BACKGROUND OF THE INVENTION

1. Field of the Invention

The invention relates to a unit fuel injector (UFI) and to a pump-line-nozzle unit (PLNU) for an internal combustion engine, with a pump element, the pump element having a pump chamber, and with a magnet valve, the magnet valve having a valve member and an armature; the magnet valve opens or closes a hydraulic connection between the pump chamber and a low-pressure region of the unit fuel injector.

2. Description of the Prior Art

In connection with the invention, the following discussion will refer only to the unit fuel injector (UFI), although pump-line-nozzle units (PLNUs) are always intended as well. The most essential distinction between unit fuel injectors and pump-line-nozzle units is that a pump-line-nozzle unit has a short high-pressure line between the pump element and the injection nozzle. For the present invention, this distinction does not matter, and hence the invention applies equally for unit fuel injectors and pump-line-nozzle units.

A unit fuel injector is known for instance from German Patent Disclosure DE 198 37 333 A1. In this unit fuel injector, the valve and the armature of the magnet valve are connected to one another nonpositively by a compression spring. Because the valve member and the armature are coupled only nonpositively, the dynamic performance of the magnet valve is difficult to control, and it is hardly avoidable that during operation, the armature and the valve member will repeatedly briefly separate from one another and after that collide again. This process is known as "bouncing". The bouncing is unwanted, since it has an adverse effect on the precision with which the magnet valve opens and closes. Moreover, the bouncing causes high wear to the armature, which is of a soft material, so that the valve stroke and thus also the operating performance of the magnet valve vary over the course of time. Finally, it should also be mentioned that the armature must be guided in a capsule, and for structural reasons this guide can only be relatively short. As a consequence, the armature has a tendency to tilting, and the armature guide wears down relatively quickly.

In a unit fuel injector and a pump-line-nozzle unit according to the invention for an internal combustion engine, with a pump element, the pump element having a pump chamber, and with a magnet valve, the magnet valve having a valve member and an armature, and in which the magnet valve opens or closes a hydraulic connection between the pump chamber and a low-pressure region, it is provided that the armature is fixedly connected to the valve member.

SUMMARY AND ADVANTAGES OF THE INVENTION

As a result of fixedly connecting the armature and valve member, bouncing of the armature on the valve member can be effectively averted. Because of the rigid, fixed connected between the armature and the valve member, a separate guide of the armature can be omitted, since the armature is guided by the valve member. Tipping or tilting of the armature in its guide during operation and the resultant functional problems of the unit fuel injector therefore no longer occur.

An especially advantageous aspect of the embodiment according to the invention is also that the number of components needed is reduced, since a separate compression spring that keeps the armature in contact with the valve member can be omitted. As a result, the manufacturing and installation costs are reduced, and less installation space is required.

In an advantageous feature of the invention, it is provided that a receiving mandrel is embodied on the valve member, and that the armature is fixedly connected to the receiving mandrel. In particular, it is advantageous if the armature is connected to the receiving mandrel by nonpositive engagement, in particular by pressing. As a result of this structural embodiment of the connection between the valve member and the armature, a secure and economical connection between the armature and the valve member can be made in a simple way. It is also possible to position the armature with high precision relative to the valve seat of the valve member. As a result, production tolerances in mass production can be compensated for by a suitable mounting of the armature on the receiving mandrel. The operating performance of various individual examples in a large-scale series is consequently virtually identical. This advantage is of considerable significance, since controlling the unit fuel injector of the invention is based on a certain predetermined, programmed-in operating performance of the unit fuel injector. Any deviation of the unit fuel injector from this programmed-in, predetermined operating performance makes the operating performance of the engine worse.

The range of deviation in operating performance of the unit fuel injector of the invention can be further improved by providing that a sealing face and a stroke stop are embodied on the valve member, and that the maximum stroke of the valve member is defined by the spacing in the axial direction between the sealing face and the stroke stop. This means that even during production of the valve member of the invention, the maximum stroke of the valve member is predetermined. Since the spacing in the axial direction between the sealing face and the stroke stop is easy to accomplish in production and can also be well monitored by measuring instruments, the deviation in the valve stroke from one example to another in a series is virtually zero.

As with other magnet valves as well, it has proved advantageous to embody the sealing face frustoconically, so that with a likewise frustoconical valve seat embodied in the valve housing, it forms a conical sealing seat.

To improve the operating performance of the magnet valve of the invention, a magnet plate cooperating with a coil of the magnet valve is provided between the armature and the stroke stop, and the receiving mandrel of the valve member protrudes through a bore in the magnet plate. With the aid of the magnet plate, it is possible to optimize the magnetic flux of the coil, so that the magnetic forces exerted on the armature of the magnet valve as a consequence of an electric current flowing through the coil are maximized, and the electrical power loss is minimized.

To enable adjusting the operating performance of the magnet valve in the installed state, a compression spring acting on the valve member is provided, whose prestressing force is very easily adjustable with the aid of an adjusting disk. By replacing this adjusting disk with another adjusting disk of a different thickness, the operating performance of different examples of magnet valves of the invention can be further improved, and the variations from one another among various examples in a series can be further reduced.

So that no fuel can reach the coil, the armature is embodied in encapsulated form. This can be done especially advantageously according to the invention by providing that the armature is surrounded by a capsule; that a spacer ring of a nonmagnetic material, in particular stainless steel, is provided between the capsule and the magnet plate; and that the capsule, spacer ring, and magnet plate are connected in sealing fashion to one another. Especially preferably, the capsule, spacer ring and magnet plate are welded or soldered to one another.

To assure high functional reliability and a long service life, the valve member is guided at least one point, but preferably at two points, in a housing. As a result, it is assured that the sealing face of the valve member always strikes the valve seat in the valve housing parallel to the valve seat, and moreover the armature does not rest on the capsule, which does not move relative to the valve housing, and as a result the armature does not wear down.

So that the magnet valve of the invention will assume its open position when the coil is made currentless, a compression spring is provided between the valve member and the valve housing.

The magnet valve of the invention can be installed especially advantageously by means of a method in which the fully machined valve member is locked in a receptacle of a fixed installation device; the magnet plate and the spacer plate are mounted on the receiving mandrel; the magnet plate, spacer plate and valve member are pressed against the receptacle; next, the magnet plate and the spacer plate are displaced by a predetermined amount relative to the valve member; and the armature is secured to the receiving mandrel of the valve member in such a way that the armature rests on the magnet plate.

By means of this method, it is easily possible, despite the production tolerances that occur in every mass production, to adjust the valve stroke exactly and with very great repeatability. In the process, production tolerances among individual components do not adversely affect the precision of the adjusted valve stroke.

It has proved advantageous if the magnet plate and the spacer plate are displaced by an amount that corresponds to the sum of the valve stroke and a desired remanent air gap between the armature and the magnet plate in the closed state of the magnet valve.

To prevent fuel from being able to reach the coil of the magnet valve, a spacer ring and a capsule are then slipped onto the magnet plate and tightly welded to one another.

For calibrating the magnet valve, the compression spring and the valve member are then inserted into the valve housing; a coil of the magnet is triggered with a current which is selected such that the magnetic force exerted on the armature is greater than the spring force that is to be exerted by the compression spring on the valve member; the spring force exerted by the compression spring on the valve member is recorded as a function of the position of the magnet valve in the housing; the recorded spring force and travel graph is evaluated; and if needed, a correction is made in the thickness of the adjusting disk.

By means of this method for calibrating the magnet valve of the invention, it can be assured in a simple way that the current with which the coil must be triggered for closing the magnet valve will be virtually identical in all examples in a series. As a result, there is a very uniform operating performance of the magnet valve of the invention. Once the initial tension of the compression spring has been adjusted, function monitoring can be performed, and if needed, another correction of the thickness of the adjusting plate is made. This step is done until such time as the function of the unit fuel injector is in accordance with the required demands.

BRIEF DESCRIPTION OF THE DRAWINGS

Further advantages and advantageous features of the invention can be learned from the ensuing description, taken in conjunction with the drawings, in which.

DESCRIPTION OF THE PREFERRED EMBODIMENTS

Figure 1:
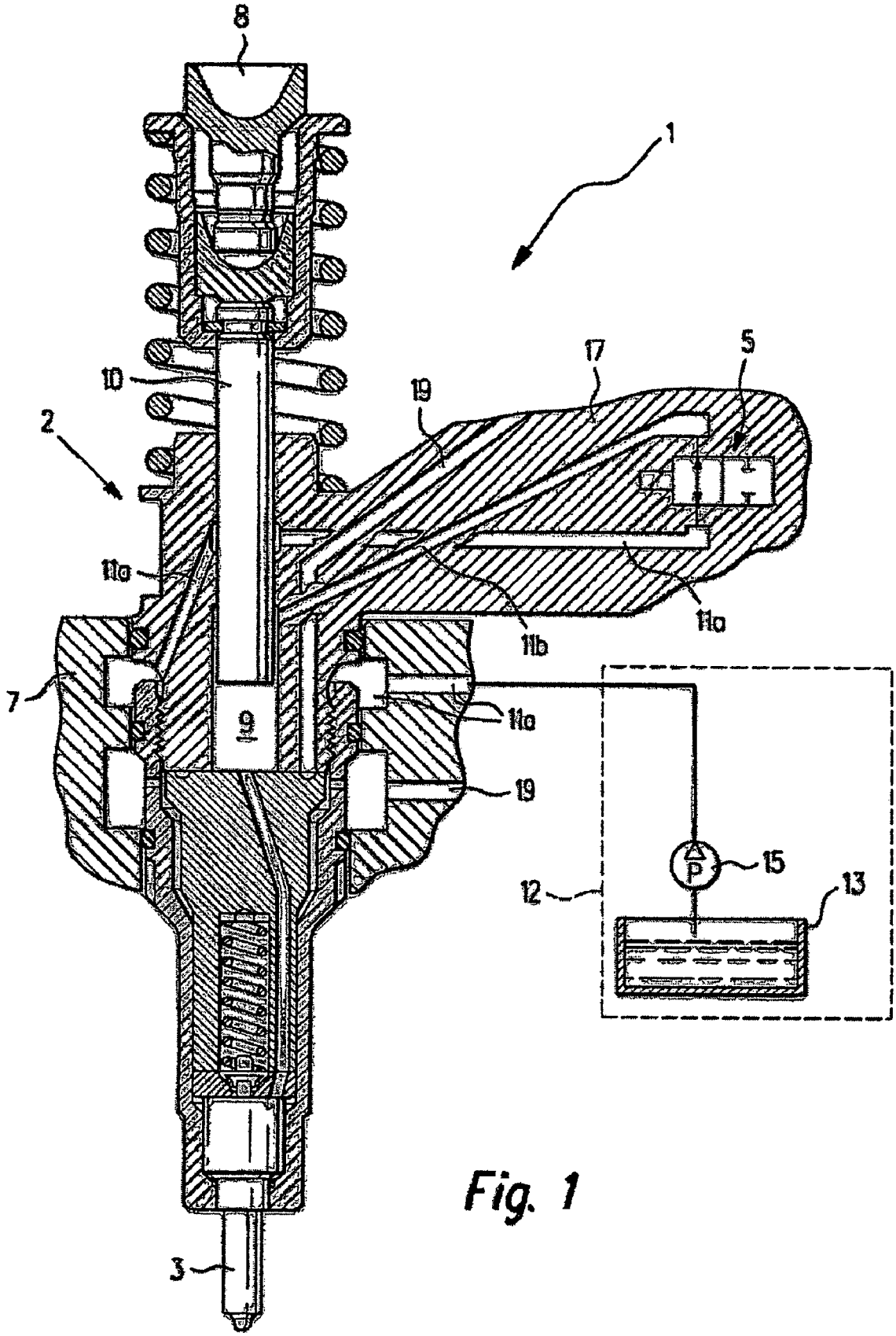
FIG. 1 is a unit fuel injector of the invention, with an only schematically shown magnet valve.

In FIG. 1, a unit fuel injector is identified overall by reference numeral 1. The unit fuel injector 1 serves to inject fuel into a combustion chamber of a direct-injection internal combustion engine (not shown). It has a pump element 2, which builds up the requisite injection pressure. Via an injection nozzle 3, the fuel, brought at high pressure from the pump element 2, is injected into the combustion chamber (not shown).

The unit fuel injector 1 is controlled by a 2/2-way control valve 5 which is shown in the form of a block circuit diagram in FIG. 1.

The control valve 5 is triggered by an actuator, not shown in FIG. 1, in particular an electromagnetic actuator.

As in every unit fuel injector, the pump element 2 and the injection nozzle 3 form a unit. For each cylinder of the engine, one unit fuel injector 1 is built into the cylinder head 7 of the engine and driven, either directly via a tappet or indirectly via tilt levers, by a camshaft of the engine (not shown) via an actuating element 8.

A pump chamber 9 of the pump element 2 communicates, via a fuel inlet 11, with a low-pressure fuel supply 12. The low-pressure fuel supply 12 may for instance comprise an electrically driven prefeed pump 15 and a fuel filter (not shown), which aspirate fuel from a fuel tank 13 via a line.

The control valve 5 splits the fuel inlet into two portions 11*a* and 11*b*. The control valve 5 is triggered by a control unit, not shown, and opens the hydraulic connection between the pump chamber 9 and the tank 13, as shown in FIG. 1, or closes it (not shown). The portion of the fuel inlet 11 that is located between the control valve 5 and the prefeed pump 15 is identified in FIG. 1 by reference numeral 11*a*, while the portion between the control valve 5 and the pump chamber 9 is identified by reference numeral 11*b*.

When the control valve 5 is opened, fuel can flow into the pump chamber 9 during the intake stroke of the pump piston 10. In the ensuing pumping stroke of the pump piston 10, the fuel previously pumped into the pump chamber 9 is pumped back into the tank 13, as long as the control valve 5 is open. This also means that a pressure sufficient to open the injection nozzle 3 does not build up in the pump chamber 9.

When fuel is to be injected via the injection nozzle 3 into the combustion chamber, not shown, of the engine, the control valve 5 is closed during the pumping stroke of the pump piston 10. As a result, the fuel can no longer be pumped out of the pump chamber 9 back into the tank 13, and in the pump chamber 9 a high pressure builds up, which finally leads to the opening of the injection nozzle 3 and hence to the injection of fuel into the combustion chamber (not shown) of the engine. The onset of the injection of fuel into the combustion chamber can be determined by the closing time of the control valve 5. The injection of fuel into the combustion chamber is terminated by opening the control valve 5 again.

Figure 2:
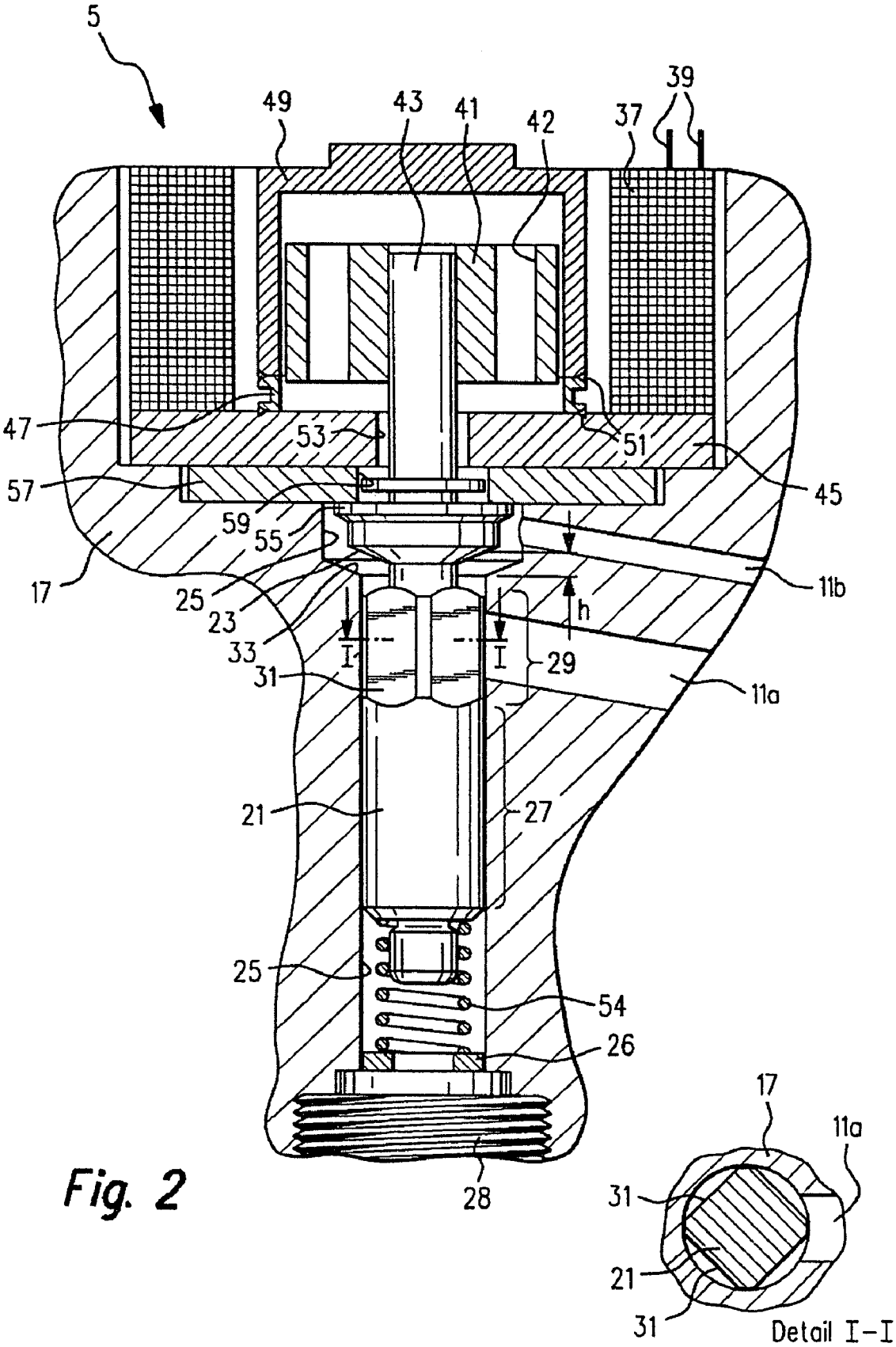
FIG. 2, one exemplary embodiment of a magnet valve of the invention in the assembled state.

In FIG. 2, a magnet valve 5 is shown in section. As FIG. 1 shows, the magnet valve 5 is integrated into the housing 17 of the unit fuel injector 1. It is understood that it would also be possible for this magnet valve 5 to be built into a separate valve housing (not shown).

The magnet valve 5 comprises a 2/2-way valve with a valve member 21. The valve member 21 has a frustoconical portion, on which a sealing face 23 is located. The valve member 21 is guided in a bore 25 of the housing 17. On its lower end in terms of FIG. 2, the valve member 21 has a guide portion 27, which cooperates without play with the bore 25, so that the valve member 21 is securely guided.

As needed, a second guide portion 29 may also be embodied on the valve member 21, in the vicinity of the sealing face 23. In this second guide portion 29, there is a plurality of flat faces 31, distributed over the circumference of the valve member 21. The flat faces 31 may for instance be distributed over the circumference at intervals of 120° or 90°. The flat faces 31 serve to establish a hydraulic connection between the portion 11*a* of the fuel inlet 11 and the portion 11*b* of the fuel inlet 11 when the magnet valve 5 is open. Above the second guide portion 29 in the housing 17, a valve seat 33 is provided. When the valve member 21 moves downward in terms of FIG. 2, until the sealing face 23 rests on the valve seat 33, the hydraulic connection between the portions 11*a* and 11*b* of the fuel inlet 11 is interrupted, and the control valve 5 is closed.

In the lower portion of the bore 25, there is a closure element 28, which is secured in the housing 17. On the lower end of the valve member 21, a compression spring 54 is provided in the bore 25; this spring is braced on one end against an adjusting disk 26 for adjusting the spring force and on the other against the valve member 21 and lifts the valve member from the valve seat 33 when a coil 37 is made currentless. The adjusting disk 26 in turn rests on the closure element 28, and if the needs arises, it can be very easily replaced.

The coil 37 has two electrical terminals 39, by way of which the coil 37 can be supplied with electric current. The delivery of current to the coil 37 is controlled by a control unit, not shown, of the unit fuel injector or of the engine.

In the interior of the toroidal coil 37, there is an armature 41. The armature 41 is pressed onto a receiving mandrel 43 of the valve member 21. Below the coil 37, a magnet plate 45 is provided, which comprises a material which is a good conductor of the magnetic field lines of the coil 37. By means of the magnet plate 45, the heat generated in the coil 37 is dissipated, and the magnetic force exerted by the coil 37 on the armature 41 is increased. A spacer ring 47 of a nonmagnetic material, such as stainless steel, and a capsule 49 are slipped onto on the magnet plate 45. The capsule 49 and the spacer ring 47, like the spacer ring 47 and the magnet plate 45, are joined together in fluid-tight fashion by weld seams 51.

The armature 41 does not rest with its outer diameter on the capsule 49, so that it can move freely in the axial direction of the valve member 21. In the middle, the magnet plate 45 has a through bore 53, through which the receiving mandrel 43 protrudes into the chamber (not identified by reference numeral) that is defined by the capsule 49 and the magnet plate 45.

Between the magnet plate 45 and a stroke stop 55 embodied on the valve member 21, a spacer plate 57 is provided. The spacer plate 57 has a hole 59. The hole 59 may also be embodied as an oblong slot, which extends radially outward from the center point of the spacer plate 57 as far as its outer diameter. As a result, it is possible as needed to replace the spacer plate 57 with another spacer plate 57 of a slightly different thickness D, and as a result, by way of the remanent air gap, to adjust the resultant magnetic force of the magnet valve 5 in a simple way.

The magnet valve 5 functions as follows:

When the coil 37 is made currentless, the compression spring 54 opens the magnet valve 5, by lifting the sealing face 23 of the valve member 21 from the sealing seat 33. As a result, a hydraulic connection is made between the portions 11*a* and 11*b* of the fuel inlet. As soon as current is flowing through the coil 37, a magnetic force exerted by the coil 37 on the armature 41 pulls the valve member 21 downward counter to the force of the compression spring 54, so that the sealing face 23 of the valve member 21 rests on the valve seat 33 of the magnet valve 5. As a consequence, the hydraulic connection between the portions 11*a* and 11*b* of the fuel inlet 11 is interrupted, so that a pressure buildup can take place in the pump chamber 9 of the pump element 2 (see FIG. 1).

The connection of the armature 41 to the receiving mandrel 43 by means of a cylindrical press fit has the advantage that the armature 41 can be pressed onto the receiving mandrel 43 far enough until it has reached the desired position relative to the stroke stop 55 of the valve member 21.

Figure 3:
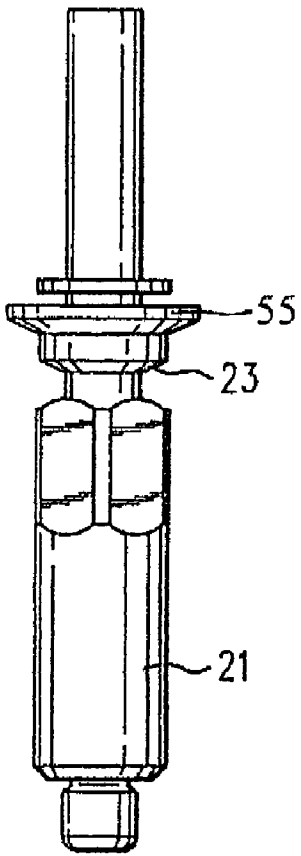

In FIG. 3, a valve member 21 is shown without a housing and without an armature. From this view it becomes clear that even in the manufacture of the valve member 21, the valve stroke of the magnet valve 5 is predetermined by the spacing of the sealing face 23 from the stroke stop 55 in the axial direction. This axial spacing of the sealing face 23 and stroke stop 55 is easy to control from a production standpoint, so that the variation among various examples in a series is only very slight. Even this is already an important precondition for assuring that the magnet valves 5 in one series of unit fuel injectors 1 according to the invention will have a virtually identical operating performance.

From FIGS. 4 through 7, the installation and calibration of a magnet valve 5 will now be described. From the description of FIGS. 4 through 7, the advantages of the method claimed according to the invention for installing a magnet valve can also be made clear.

The installation and calibration of the magnet valve 5 are done in an installation device or fixture 61. This installation device 61 includes a cylindrical receptacle 63, in which the valve member 21 is received. The valve member 21 rests with the underside of the stroke stop 55 on one end of the receptacle 63. Next, the spacer plate 57, which may be of simple steel, and the magnet plate 45 are placed on the valve member 21 in such a way that the spacer plate 57 rests on the stroke stop 55, and with the aid of a pressing sleeve 65, the magnet plate 45 and the spacer plate 57 are pressed against the stroke stop 55.

Figure 4:
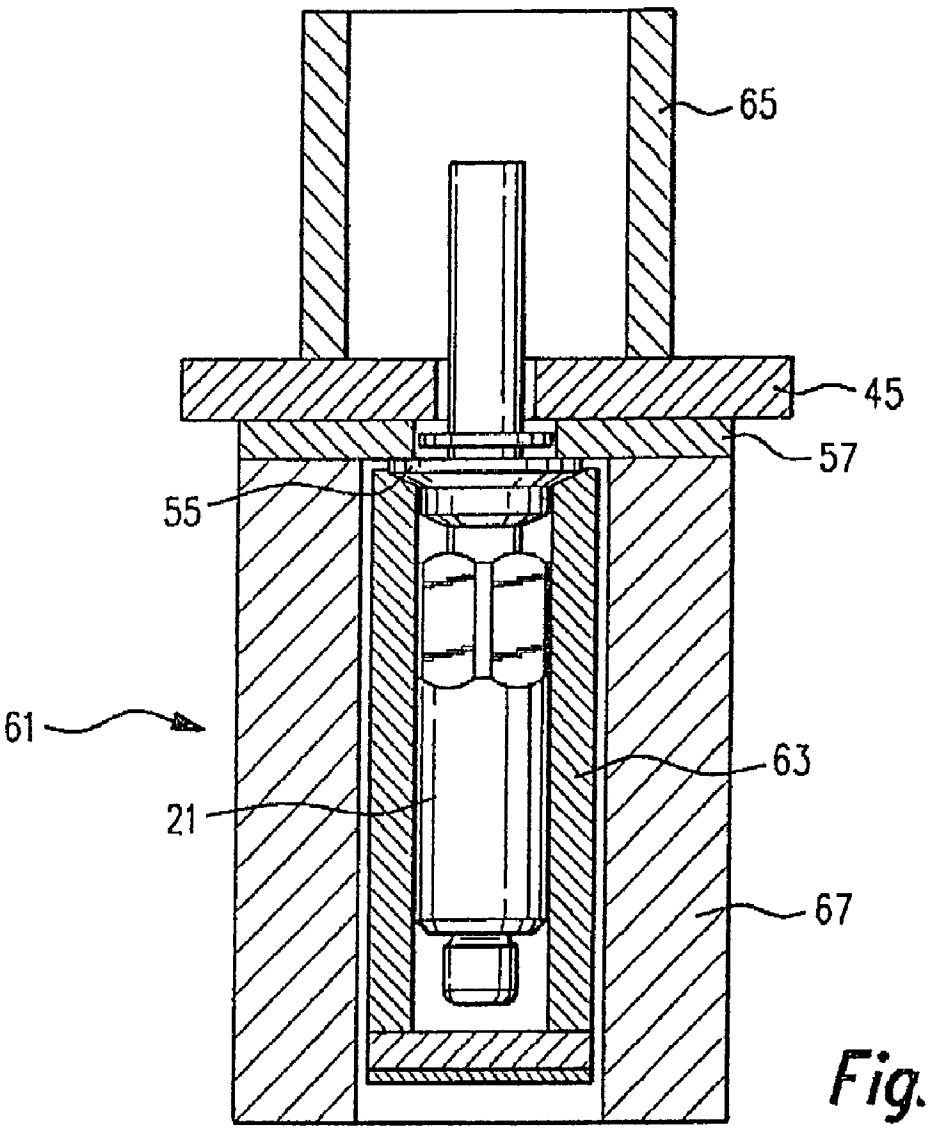
FIGS. 3-7 show structural details of the magnet valve of the invention.
Figure 5:
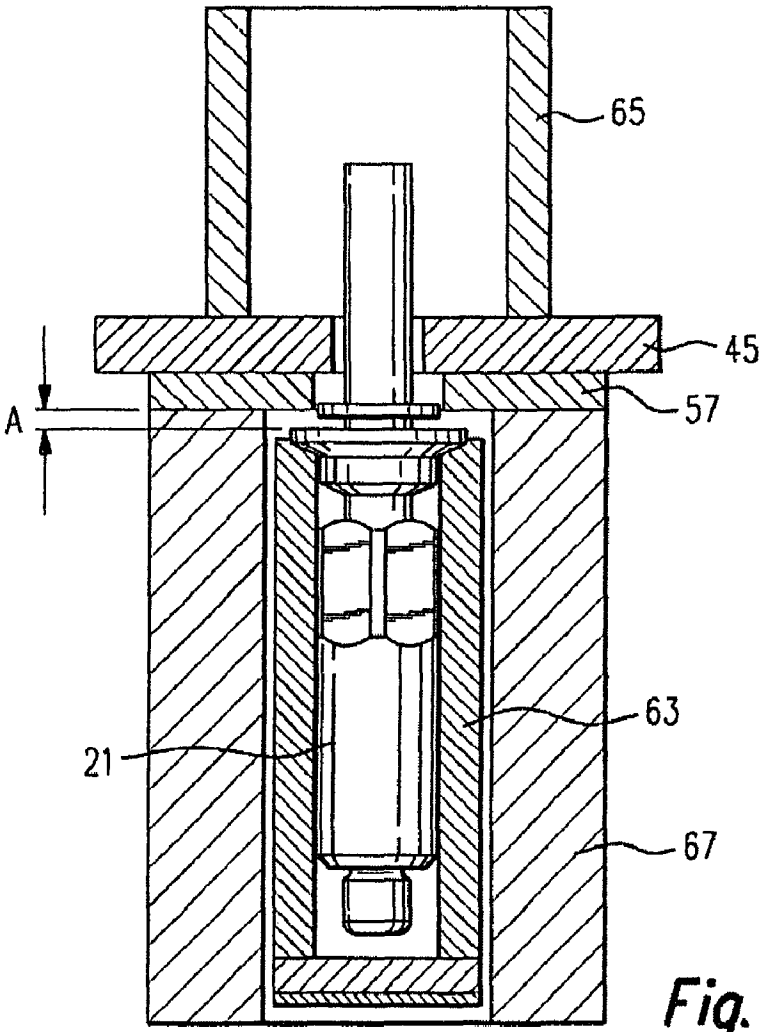

In a further step, an installation sleeve 67 is driven from below against the spacer plate 57. Once the installation sleeve 67 has been driven from below against the spacer plate 57, without the spacer plate 57 lifting from the stroke stop 55 as a result, the position of the installation sleeve 67 is detected. Next, the installation sleeve 67 in FIG. 4 is moved upward counter to the force of the pressing sleeve 65 by an amount A (see FIG. 5). Because of the force of gravity, the valve member 21 continues to rest on the receptacle 63 in the position shown in FIG. 4. In other words:

The spacer plate 57 and the magnet plate 45 move away from the stroke stop 55 by an amount A relative to the valve member 21. This position of the spacer plate 57 and magnet plate 45 is shown in FIG. 5. The amount A is equivalent to the desired maximum valve stroke, plus a required remaining gap between the armature 41 and the magnet plate 45 in the closed state (not shown).

The installation sleeve 67 is locked in the position shown in FIG. 5 relative to the receptacle 63. Next, the armature 41 is pressed from above onto the receiving mandrel 43 of the valve member 21 (see FIG. 6). As a result, the valve stroke of the magnet valve 5 is thus adjusted and production inaccuracies in the manufacture of the valve member, the spacer plate 57, the magnet plate 45, and the armature 41 do not affect the adjusted valve stroke.

A plurality of longitudinal bores 42 are provided in the armature 41, so that the motion of the armature 41 in the capsule 49 is not hindered by the fuel (not shown) located in the capsule. At the same time, the design of these longitudinal bores 42 is utilized to achieve the optimal damping of the motion of the armature 41 and the valve member 21 at the end of the stroke. To that end, the longitudinal bores 42 may have one or more throttle restrictions, not shown.

Figure 6:
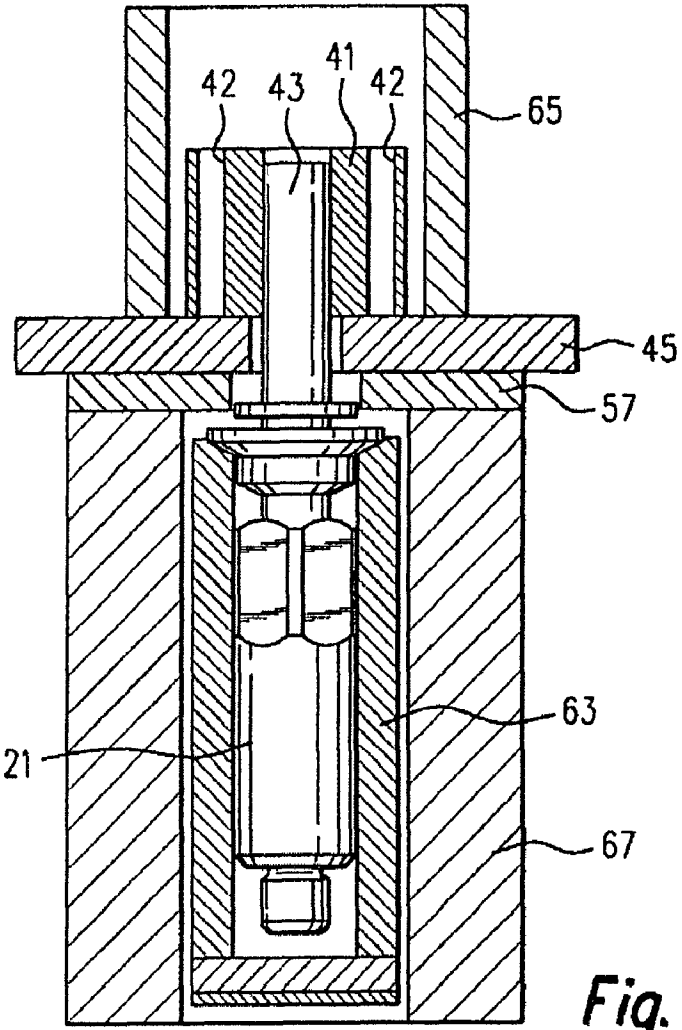
Figure 7:
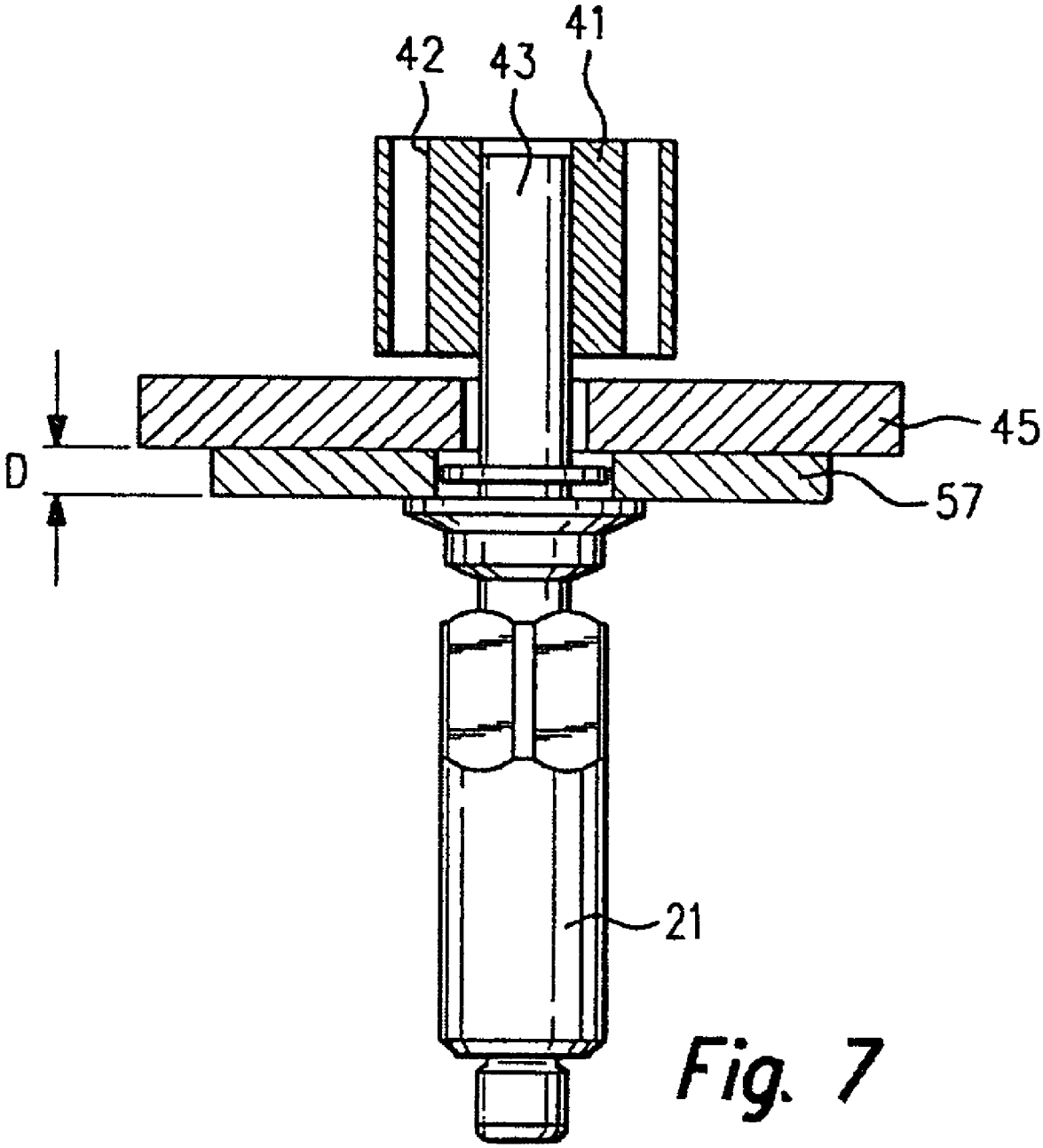

In FIG. 7, the structural group, comprising the valve member 21, spacer plate 57, magnet plate 45 and armature 41, that is preassembled as shown in FIGS. 4 through 6 is shown. Next, the spacer ring 47 and the capsule 49 are welded onto the magnet plate, as shown in FIG. 2. This structural group can now be inserted into the housing 17.

Since the compression spring 54 has a certain variation in terms of its dimensions and spring rate, it is advantageous to calibrate the magnet valve when the valve member 21 and the compression spring 54 are built into the housing 17. To that end, in a first step, the coil 37 is supplied with a predetermined current. This current is so great that the coil 37 exerts a magnetic force on the armature 41 that is greater than the desired prestressing force of the compression spring 54. In a second step, the structural group, together with the compression spring 54, is pushed into its installed position in the housing 17, and the spring force exerted in the process on the valve member 21 by the compression spring 54 is measured and recorded as a function of the position of the valve member 21 in the housing 17. Next, the current supply to the coil 37 is interrupted. By evaluating the previously ascertained spring force and travel graph, it can be found whether, in the desired installed position, the spring force exerted by the compression spring 54 is correct.

If that proves not to be the case, then the spring force of the compression spring 54 can be adjusted by replacing the adjusting disk 26 with an adjusting disk 26 (see FIG. 2) of a different thickness.

Next, it is checked whether the magnet valve 5 closes when the coil 37 is supplied with the desired current intensity $I_{set}$. If the function of the magnet valve 5 proves not to be satisfactory, then the desired closing performance and opening performance of the magnet valve 5 can be adjusted by means of a further replacement of the adjusting disk 26. This operation is repeated until such time as the magnet valve 5 functions correctly.

By means of the magnet valve 5 of the invention, essentially the following advantages are obtained:

The bouncing between the armature 41 and the valve member 21 is entirely avoided.

There is therefore now only one compression spring 54 that acts on the valve member 21, with a favorable effect on the manufacturing costs and on the space required for the compression spring 54. In the prior art, two compression springs are necessary, one of which acts on the armature 41 and keeps it in contact with the valve member 21.

The adjusting disk 26 is a component that is relatively unproblematic to manufacture, and there is no need, as in the prior art, to pair different components in order to adjust the magnet valve 5. The desired opening and closing performance of the magnet valve 5 can be adjusted merely by replacing the adjusting disk 26. Moreover, adjusting the magnet valve 5 is made markedly simpler by the provision that the armature 41 and the valve member 21 form a component that is solidly joined together and whose dynamic performance is comparatively simple to control.

The armature 41 is guided by the valve member 21, so that in the region of the armature 41 and the capsule 49, separate guidance of the armature is no longer necessary, which reduces the costs and increases the functional reliability of the unit fuel injector of the invention.

Moreover, the advantage, known from the prior art, of a dry coil 37 can also be retained in the magnet valve 5 of the invention.

The foregoing relates to a preferred exemplary embodiment of the invention, it being understood that other variants and embodiments thereof are possible within the spirit and scope of the invention, the latter being defined by the appended claims.

The invention claimed is:

1. A method for installing a magnet valve with an armature and a valve member including a receiving mandrel into a housing, the method comprising:

locking the valve member in a receptacle of a fixed installation device;

mounting a magnet plate and a spacer plate on the receiving mandrel of the valve member;

pressing the magnet plate, spacer plate and the valve member against the receptacle;

displacing the magnet plate and the spacer plate by a predetermined amount relative to the valve member;

connecting the armature and the receiving mandrel, so that the armature rests on the magnet plate.

2. The method as defined by claim 1, wherein the predetermined amount is equivalent to a sum of a valve stroke and a remanent air gap between the armature and the magnet plate.

3. The method as defined by claim 2, further comprising placing a spacer ring and a capsule onto the magnet plate and tightly welding the spacer ring, capsule and the magnetic plate to one another.

4. The method as defined by claim 1, further comprising placing a spacer ring and a capsule onto the magnet plate and tightly welding the spacer ring, capsule and the magnetic plate to one another.

5. The method as defined by claim 1, wherein the magnetic valve is mounted in the housing by inserting a compression spring and the valve member into the housing, triggering a coil of a magnet valve with a current that is selected such that the magnetic force exerted on the armature is greater than a spring force that is exerted by the compression spring on the valve member; recording the spring force, exerted on the valve member by the compression spring, as a function of a position of the valve member in the housing; evaluating the recorded spring force and travel graph; and, correcting the spring force exerted by the compression spring by inserting an adjusting plate bearing on the compression spring.

6. The method as defined by claim 5, wherein, once the spring force of the compression spring has been corrected, function monitoring is performed, and another correction of a thickness of the adjusting plate is made.

* * * * *